United States Patent [19]

Takeda et al.

[11] 4,283,890

[45] Aug. 18, 1981

[54] TRANSPORTABLE BED FOR INDUSTRIAL EQUIPMENT

[75] Inventors: Shojiro Takeda; Bunji Kinno; Yutaka Yamaguchi, all of Chiba, Japan

[73] Assignee: Toyo Engineering Corporation, Tokyo, Japan

[21] Appl. No.: 5,953

[22] Filed: Jan. 24, 1979

[30] Foreign Application Priority Data

Feb. 7, 1978 [JP] Japan ..... 53/11986

[51] Int. Cl.[3] ..... E04B 1/34; E04B 1/35

[52] U.S. Cl. ..... 52/143; 52/79.1; 52/173 R; 52/745; 108/51.1; 414/12; 414/786

[58] Field of Search ..... 414/10, 12, 786; 52/79.1, 143, 173 R, 745; 108/51.1; 248/544; 404/12, 786

[56] References Cited

U.S. PATENT DOCUMENTS

| | | | |
|---|---|---|---|
| 1,691,037 | 11/1928 | Allen | 52/745 X |
| 2,511,613 | 6/1950 | Woolslayer et al. | 52/143 X |
| 2,720,323 | 10/1955 | Hoiles | 108/51.1 X |
| 3,294,041 | 12/1966 | Lessheim | 108/51.1 |
| 3,490,632 | 1/1970 | McKinney | 52/143 |
| 3,795,206 | 3/1974 | Utz | 108/51.1 |
| 3,818,655 | 6/1974 | Carter, Sr. | 108/51.1 X |
| 3,820,664 | 6/1974 | Lewis | 414/12 X |
| 3,833,138 | 9/1974 | Dean | 108/51.1 X |

FOREIGN PATENT DOCUMENTS

| | | | |
|---|---|---|---|
| 2276788 | 1/1976 | France | 52/745 |

*Primary Examiner*—Alfred C. Perham

*Attorney, Agent, or Firm*—Blanchard, Flynn, Thiel, Boutell & Tanis

[57] ABSTRACT

A transportable bed useful as a support for industrial equipment and machinery, during erection, transportation and installation thereof. The transportable bed comprises a horizontal floor on which the industrial equipment and machinery can be mounted, a central strengthening structure extending downwardly from the support and comprising at least two laterally spaced-apart girders, and side supports for supporting the sides of the floor.

6 Claims, 19 Drawing Figures

(ALTERNATIVE TO FIG. 2e)

TRANSPORTABLE BED FOR INDUSTRIAL EQUIPMENT

BACKGROUND OF THE INVENTION

1. Field of the Invention

The present invention relates to a transportable bed or platform for supporting various constituents of industrial equipment, which bed is adapted to be used in the construction of industrial equipment wherein the constituents of the said industrial equipment are built on one or more beds at the factory so as to form one or more unit structure sections of the industrial equipment, transporting the unit structure section or sections to the installation site and installing them along with the beds on a foundation, thereby to complete the construction work.

2. Description of the Prior Art

In building industrial equipment or plants of various types by a conventional technique, the component parts of the equipment are separately fabricated at a factory or factories, transported to the installation site, installed on foundations prepared at the site and, then, connected to each other by piping and/or electric wiring to complete the construction of the total assembly of the equipment.

In view of the current tendency toward more complicated construction of the individual components themselves and the connections therebetween, it is quite troublesome and inconvenient in all the aspects of transportation, storing, assembling and testing, to complete the construction by employing such steps as dividing the large components into a plurality of sub-components, packing and transporting the sub-components and small constituents in separate packages, sorting and storing them at the installation site for more efficient assembling in accordance with the progress of the construction work, assembling and combining the components and then testing the completed installation using engineers of various technical fields who are sent to the installation site from the factory. Such a construction procedure requires a large number of engineers and workers and a highly systematic organization, if the contract terms are to be strictly fulfilled.

This problem is serious especially when the construction is performed in an under-developed region, because it is difficult to maintain acceptable communication and transportation systems for the frequent coming and going of engineers, living conditions such as dormitories, as well as electric power and water resources. In addition, weather conditions are often severe in under-developed regions, which makes it extremely difficult to build and maintain proper living conditions for a large number of persons engaged in the construction work for a long time.

The demand for such construction work in these under-developed regions is, however, increasing.

To comply with this demand, it has already been done to modify a large existing vessel so that it will accomodate a large plant, or to build the entire plant on a specifically designed floating base. The vessel or the floating base is towed to the site across the sea, and it is then fixed or moored whereby to function as a complete installation of the industrial equipment situated in a body of water at the site.

It has also been proposed to carry out the construction by the steps of building the entire industrial equipment on a flat bed at a factory where construction equipment and skilled workers are available, transporting the built industrial equipment along with the bed to a site on land, or fixing the equipment together with the bed to a floating base for sea transportation and then landing and transporting it to the land site, so that the equipment can be used at the land site or afloat.

According to the latter-mentioned way, when the industrial equipment to be constructed is huge, it is divided into a plurality of sections. Each section is built on its own flat bed, and the individual beds are transported to the site. Then, the sections are connected to one another at the site to complete the desired assembly of industrial equipment.

This method of construction will be described in more detail, with reference to an industrial chemical plant, by way of example, in which the connections of the component parts are critical. It is possible to remarkably shorten the construction time by reducing the amount of on-site work, by designing and building the chemical plant in a plurality of separate blocks or sections, transporting the sections to the site separately and combining them at the site to form a complete plant. In this type of construction, it is necessary to make the size of each section as large as possible, so as to reduce the number of sections as much as possible, and to work out suitable measures for ensuring a safe and efficient sea transportation and precise installation at the site.

In some cases, the sections of the equipment built at the fabrication site on flat beds, including constituent machinery, piping and wiring, will weigh 500 tons or more. In order to support this heavy weight and to ensure safe transportation of the same for many days, it is necessary to fabricate beds of very high mechanical strength, employing a large quantity of steel structural members of large cross-sectional areas and/or large H-cross-sectioned steel beams. For information purposes, it is to be noted that, in some cases, the constituent subassembly to be built on a single bed has a height of about 30 m, a width of 5 m and a weight of about 300 tons.

In building the section or sections of the equipment on the bed or beds, first the bed itself is assembled at the factory, on a temporary foundation, and then the components are built on the bed or beds. The completed subassembly and bed is then lifted for mounting on the vehicle for transportation. Thus, the bed has to have three different weight-balancing points so that it can be stably supported on the temporary foundation, on the lifting means and also on the vehicle. This requirement makes the design of the bed more difficult because of the complicated strength considerations, resulting in a further increased strength of the bed.

When the built-up subassembly of the equipment on the bed is delivered from the ground transportation vehicle to the vessel along with the bed, for the purpose of sea transportation, the bed is mounted on a temporary foundation prepared on the vessel. This temporary foundation on the vessel must also be large and strong enough to withstand large force moments caused by the pitching and rolling of the vessel as it travels across the sea.

In order to prevent the flat bed of the equipment section on the deck of the vessel from slipping along the deck surface, the bed has to be provided at its outer side with fastening means through which the bed is fastened to the deck. These fastening means are usually provided in pairs on the respective sides of the bed and, therefore, the total breadth of the bed is increased inconveniently. To accommodate this increased breadth of the bed, the vessel must also have a sufficiently large breadth.

In other words, the bed is designed to have a breadth which is reduced by a length corresponding to the total breadth of the two large fastening means which are provided at both sides of the bed. Consequently, the full breadth of the vessel or the full loading capacity of the vessel cannot be effectively utilized. At the same time, it is quite disadvantageous that the breadth of the bed is reduced due to the provision of the fastening means which are necessary only during the short period of transportation, but are unnecessary during the long time use after the final installation site.

After the transportation, in installing the section of the equipment on the foundation prepared at the installation site, it is necessary to move the bed on the foundation slightly, in order to achieve a proper location of the constituent machinery, in order that the machinery can be connected to the associated machinery of other equipment sections or to other machinery not on sections, precisely through piping and electric wiring.

When a flat bed is used, a large horizontal thrust is applied on the surface of the foundation, as a result of the horizontal movement of the contacting lower surface of the flat bed.

It is, therefore, necessary to prepare a large foundation having a high strength, because otherwise the fine adjustment of the bed position cannot be achieved. If the fine adjustment of the installation position is not correctly achieved, the number of connections at the boundaries of the equipment sections is drastically increased.

Figure 1A:
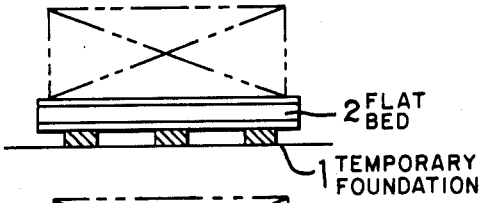
FIGS. 1(*a*)–1(*f*) show the sequence of building, transportation and installation of a unit section of industrial equipment, making use of a conventional transportable bed.
Figure 1B:
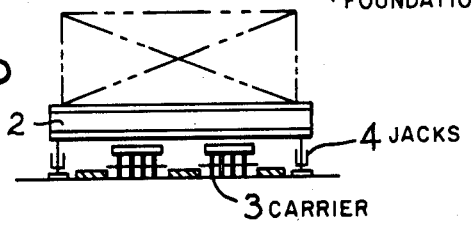
Figure 1D:
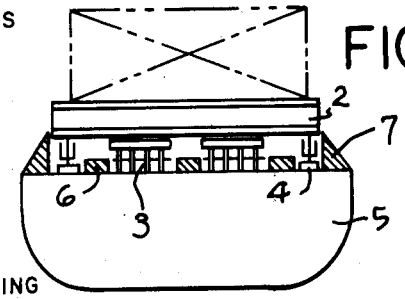
Figure 1C:
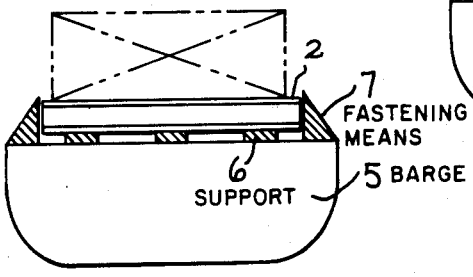
Figure 1E:
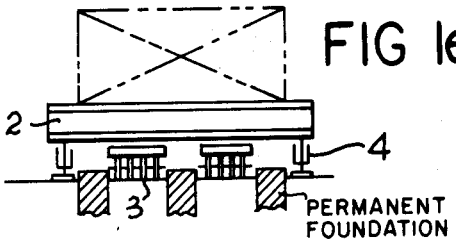
PRIOR ART FIG 1e
Figure 1F:
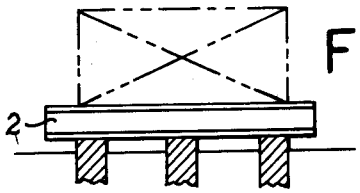
Figure 2A:
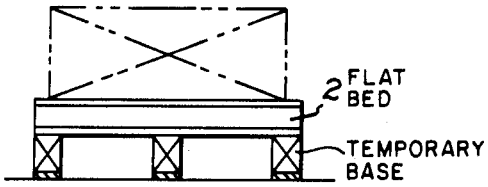
FIGS. 2(*a*)–2(*f*) show a sequence similar to that of FIGS. 1(*a*)–1(*f*), but employing temporary bases during building and transportation to eliminate troublesome repeated jacking up and jacking down operations.
Figure 2B:
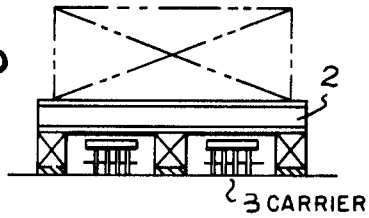
Figure 2C:
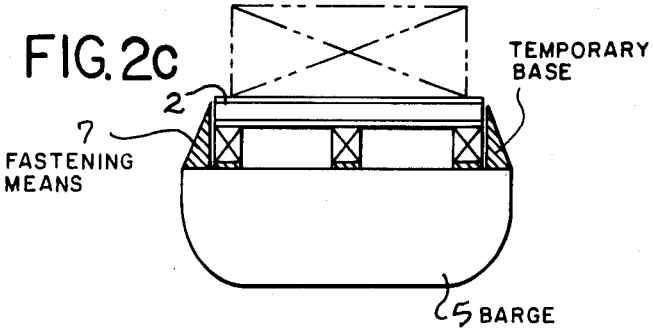
Figure 2D:
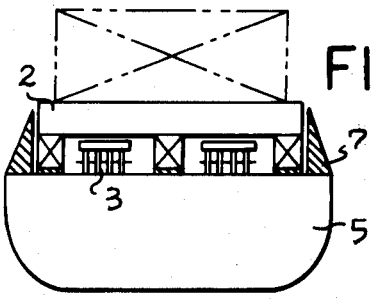
PRIOR ART FIG. 2d
Figure 2E:
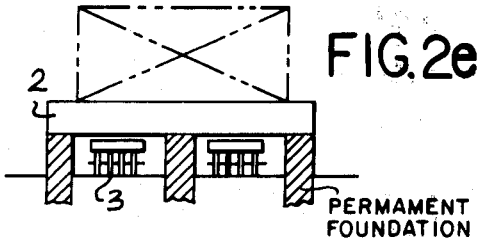
Figure 2F:
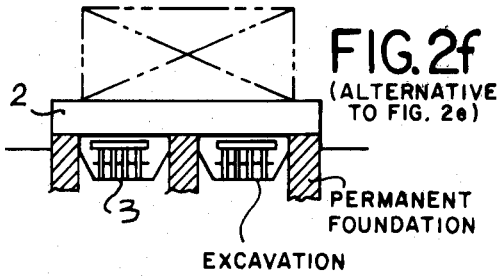

Referring to the drawings, FIGS. 1(*a*)–1(*f*) and 2(*a*)–2(*f*) illustrate the steps for lifting of the built-up equipment section at the fabrication site, transportation to the installation site and installation at the installation site. More specifically, FIGS. 1(*a*)–1(*f*) show the steps which are performed making use of jacks, while FIGS. 2(*a*) to 2(*f*) show the steps carried out when temporary supports are used in place of jacks.

Referring first to FIGS. 1(*a*) to 1(*f*), a flat bed 2 is built up on sleepers or a temporary foundation 1, as shown in FIG. 1(*a*). Then, various items of machinery are mounted on and fixed to the flat bed 2, and are mutually connected as required, thus completing the building of a unit structure section of the equipment. The assembly of machinery, i.e., the constituents of the equipment on the bed 2, is schematically illustrated by chain dotted lines. Foundations for jacks 4 are located at positions beneath the bed 2 different from the positions occupied by the sleepers or temporary foundation 1 and the space for accommodating a carrier 3. As illustrated in FIG. 1(*b*), the unit structure including bed 2 is lifted by means of the jacks 4.

Since the lifting stroke of the jacks 4 is limited in height, this lifting work is performed stepwise, wherein temporary supports are placed under the bed 2 at positions other than the positions of the jacks, after each lifting stroke, or alternatively, the same number of additional jacks are used, so as to achieve the second lifting stroke.

The bed 2 is lifted up to such a vertical height as to allow the carrier 3 to be placed into the space between the bed 2 and the foundation, by the repeated lifting operations using a combination of jacks and temporary supports, or using two sets of jacks which are used alternately.

Then, the unit structure section is delivered from the carrier to a barge 5 for the sea transportation. It is placed on the support 6 previously prepared on the barge 5 through reverse repeated and alternating use of jacks and temporary supports or two sets of jacks.

The barge 5 is provided with large fastening means 7 disposed around the periphery of the bed 2. The bed is subjected to large force moments and shearing forces during the sea transportation, due to the pitching and rolling of the barge 5.

Then, at the landing site, a lifting operation similar to that as illustrated in FIG. 1(*b*) is repeated on the barge 5 as illustrated in FIG. 1(*d*), so as to permit the unit structure section to be removed from the barge 5 by the carrier 3.

Upon arrival at the installation site, the installation is performed as illustrated in FIG. 1(*e*), in a manner similar to that shown in FIG. 1(*c*). Finally, the unit structure section is installed on the permanent foundation as shown in FIG. 1(*f*).

When the unit structure section has a large weight, it is necessary to use large jacks having a large height. For this reason, although not shown in FIG. 1, it is necessary to provide pits for attaching jacks, as well as sufficiently strong jack foundations in the pits, so that the jacks can be safely attached at the fabrication site, on the barge and at the installation site.

In the transportation procedure as shown in FIGS. 2(*a*) to 2(*f*), the troublesome repeated lifting of the unit section by means of alternating use of pairs of jacks or jacks and temporary supports is eliminated by using temporary bases at the fabricating site and on the barge, and by using jacks carried by the carrier itself. At the installation site, tall foundations are prepared or, alternatively, long slopes of small gradient for the access of the carrier and low passages for the carrier between the foundations are prepared, as shown in FIGS. 2(*e*) and 2(*f*).

The procedure as illustrated in FIG. 2, which is superior in that the repeated use of jacks is avoided, has the disadvantages that the foundations must have a large height, that the transportation is unstable because of the high position of the center of mass and because temporary bases of large mechanical strength are required.

If transportation and installation have to be made by procedures other than illustrated in FIGS. 2(*a*)–2(*f*), the use of jacks for lifting up and lowering down the unit section structure is indispensable. In such a case, the following disadvantages are inevitable.

In mounting the unit structure section on the transportation vehicle or carrier by means of jacks, and in delivering the same from the carrier to the temporary base or to the foundation, it is necessary that all the operators operate the large number of jacks strictly evenly, paying careful attention so as not to incur a localized concentration of weight on only a few. This requires long working time and much labor. In addition, the work involves a serious danger, because a large number of workers must get into the space around and possibly under the bed which is carrying a large weight.

When an ultra-heavy duty trailer having wheels of large diameter is used as the ground transportation vehicle, the flat bed 2 of the unit structure section must be lifted up from ground level a distance of at least 2 meters, in order that the trailer can be placed into the space beneath the bed. Unfortunately, the usually available heavy duty jacks have a lifting stroke as small as 0.5 m. This means that the lifting has to be made in at least 5 steps, that is, there must be performed at least 5 times the repeated and alternating use of a large number of jacks and temporary supports.

The difficulty in this lifting work is one of the important factors which affects the design of the maximum size and weight of the unit struture section including the bed and its constituent machinery.

When the flat bed 2 is used, it is necessary to maintain a space or spaces beneath the bed, so as to make the underside of the unit section structure accessible to workers for the installation and for protective maintenance after the installation is completed. For this reason, the foundations prepared at the fabrication site and at the installation site must have as large a height as possible. The increased height of the foundation necessarily requires a correspondingly increased cross-sectional area of the foundation.

It is possible to provide a minimum height of the foundation above ground level by excavating the ground between the foundation members to provide space for the access of the workers and the transportation vehicle. In this case, however, it is necessary to prepare a sloped driveway for the access of the transportation vehicle for carrying and transporting the unit structure section carried by the bed. In this case, moreover, in order to enable the transportation vehicle carrying the heavy unit structure section to climb up the slope, the slope should have a small gradient or incline, i.e., a large length relative to the increase in height, which requires a large area and costly road construction.

The use of high foundations and the excavation of the ground under the bed both require a large horizontal cross-sectional area of the foundation at the lower portion of the latter. At the same time, when the space for the access of the transportation vehicle is obtained by excavating the ground, it is necessary to leave a sufficiently large area of safe stabilized soil (not disturbed by the excavating). For these reasons, this space provided for access of the vehicle can have only a limited breadth, which may hinder the access of ultra-heavy duty trailers.

Figure 3:
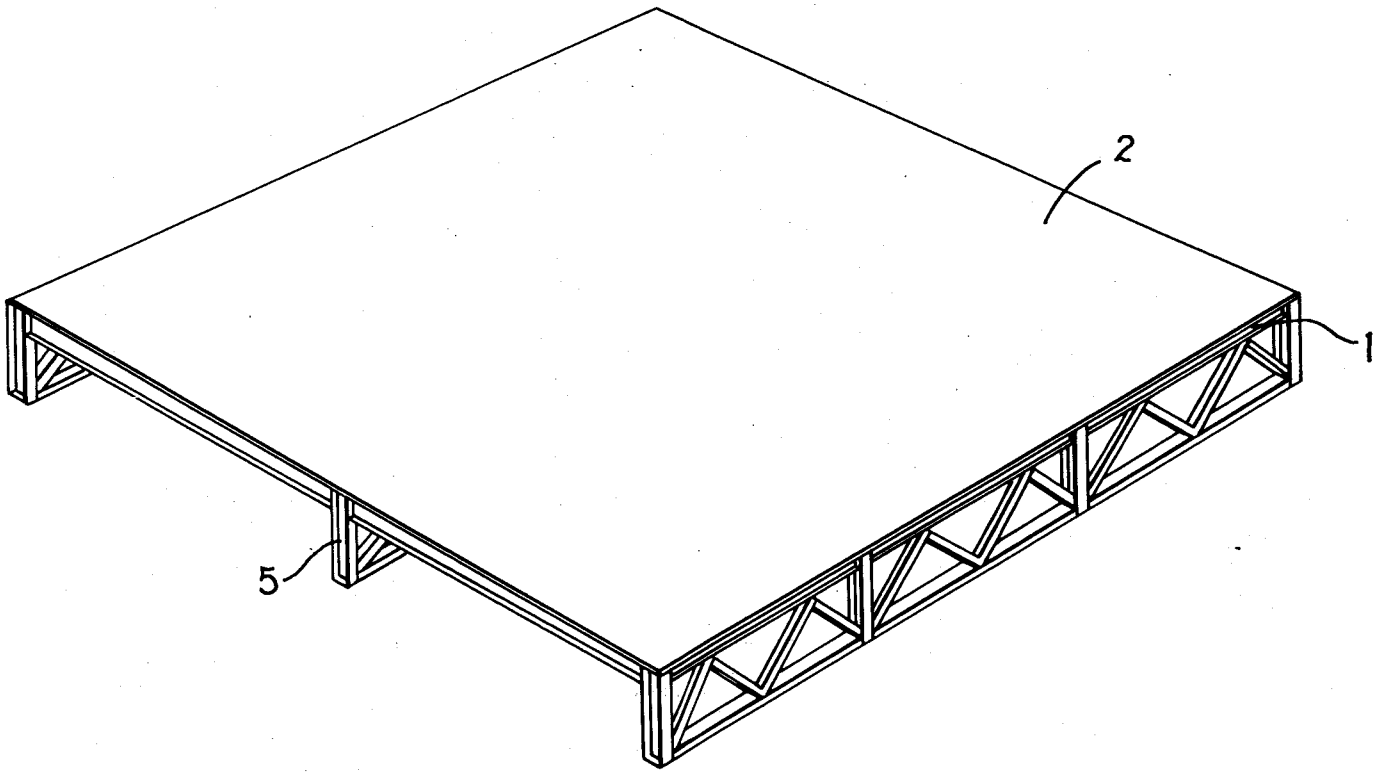
FIG. 3 is a perspective view of an example of an improvement in a conventional transportable bed.

In order to overcome the above-described problems inherent in the use of the flat bed, the present inventors have worked out and designed an improved bed construction as shown in FIG. 3. This improved bed construction, however, has the following disadvantages.

Namely, this bed still requires large-size fastening means as illustrated in FIG. 2, in order that it can be held stably on the barge, under the conditions of pitching and rolling of the barge. In addition, this improved bed construction has an extremely small mechanical strength against a force acting horizontally and normal to the lengthwise dimension of vertical legs.

The present inventors have discovered the transportable bed of the invention, through an intensive study of the conventional bed construction and the improved bed construction as shown in FIG. 3.

According to the invention, there is provided a transportable bed or platform for supporting industrial equipment and adapted to be used in the construction of industrial equipment or plants by the steps of building a part or the entirety of the industrial equipment on the transportable bed, so as to form a unit structure of a weight including the bed of 500 to 5000 tons, transporting the unit structure along with the bed to the construction site by means of a heavy duty ground transportation vehicle or a heavy duty ground transportation vehicle and a marine vessel in combination, installing the unit structure on the foundation prepared at the construction site, and connecting the unit structure with other portions of the equipment, thus completing the construction, wherein the transportable bed comprises a flat floor portion to the upper and/or lower surfaces of which and/or within which are mounted the items of industrial machinery, piping and electric wiring which constitute the industrial equipment, a central strengthening structure which is a column comprised of at least two girders attached to the lower surface of the horizontal floor section so as to maintain the latter at a level of 0.5 to 3.0 meters from the upper surface of the foundation, the girders extending in parallel with and spaced from each other, and spaces defined beneath the horizontal floor section and located on both sides of the central strengthening structure, for allowing the access of the load-carrying portion of a transportation vehicle.

If the size of the equipment to be constructed is too large to be constructed on one transportable bed, the equipment is divided into a plurality of sections. Each section is built up on its own transportable bed, so as to form a separate unit structure section. These unit structure sections are transported to the construction site separately, and are installed in side-by-side relation on the foundations prepared at the construction site. Finally, the unit structure sections are connected to one another and to external parts of the equipment, thus completing the construction.

Figure 4:
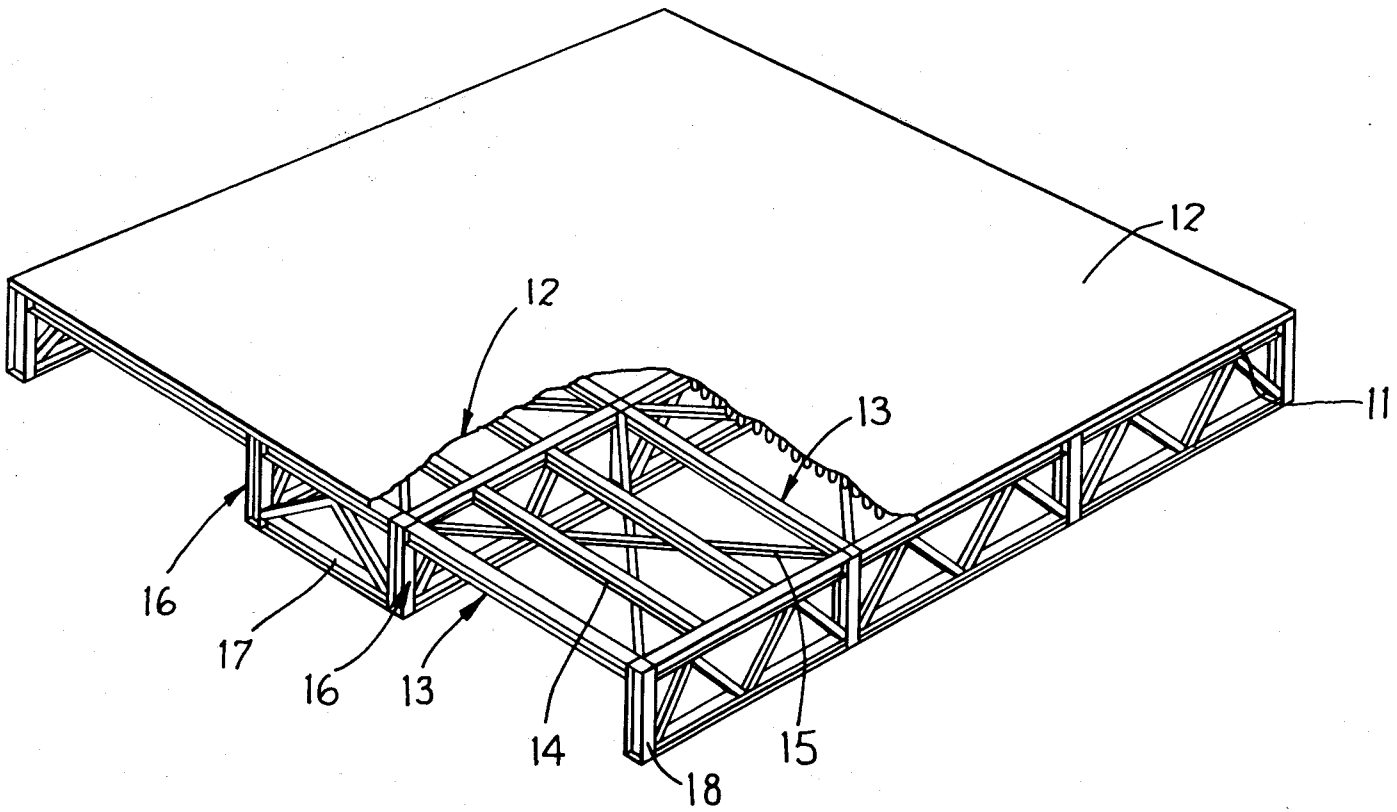
FIG. 4 is a perspective view, partially broken away, of the transportable bed in accordance with the invention.
Figure 5A:
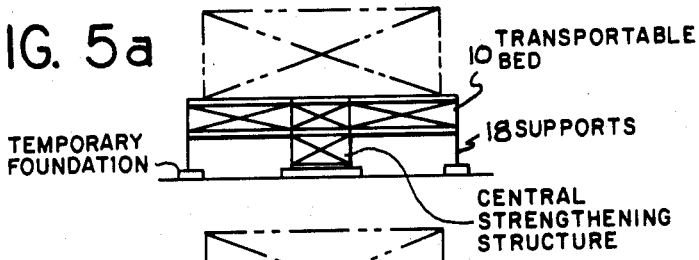
FIGS. 5(*a*)–5(*e*) show the sequence of building, transportation and installatiion of the unit structure of the industrial equipment, making use of the transportable bed in accordance with the invention.
Figure 5B:
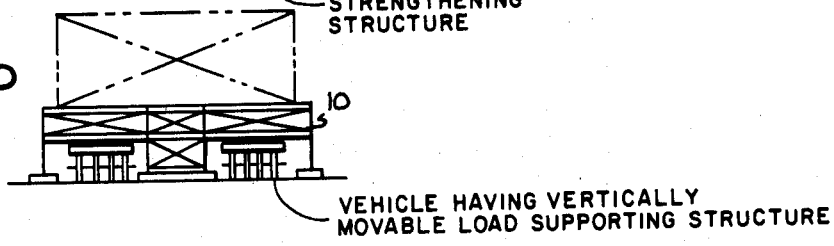
Figure 5C:
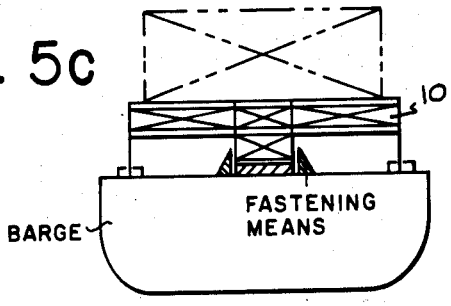
Figure 5D:
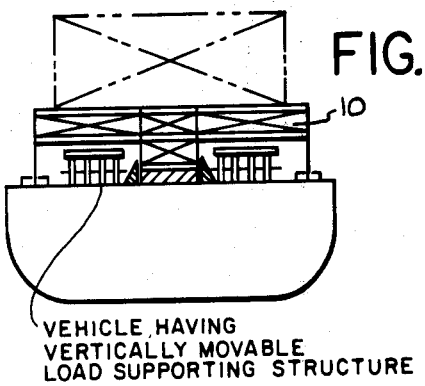
Figure 5E:
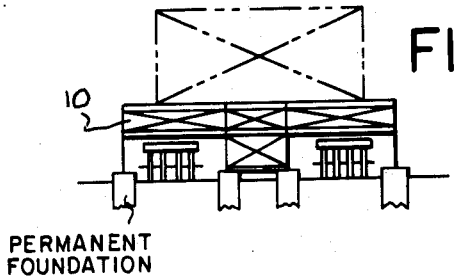

Referring now to FIG. 4, which is a perspective view of the transportable bed 10 in accordance with the invention, a flat floor section 11 has an upper wall 12 made of steel plates or other similar structural floor materials. Pumps, compressors and other machinery, as well as towers and tanks, can be installed on the flat floor section 11, making use of the upper wall 12 as the deck for supporting those items of equipment.

A floor-reinforcing structure 13, built of structural shapes such as steel beams 14 and like materials is adapted to carry and reinforce the upper wall 12. This floor-reinforcing structure 13 functions as a rigid support for the entire unit structure of the equipment during the transportation.

Beams 15 can be attached to the lower side of the reinforcing structure 13, underneath the beams 14, for further reinforcing the flat floor section 11, and for functioning as a truss to act as a bearing surface when the unit structure is carried by the heavy duty transportation vehicle.

Two parallel elongated vertical structural frameworks 16,16 are secured rigidly to the upper wall 12, the floor-reinforcing structure 13 and to the beams 14, so as to extend downwardly from the lower side of the flat floor section and at a suitable horizontal distance from each other. The frameworks 16,16 extend from one longitudinal end to the other longitudinal end of the transportable bed 10. The respective structural frameworks 16,16 are located substantially equal distances from the respective side edges of the transportable bed 10, so as to define a structure which is substantially symmetrical about its longitudinal center line.

The structural frameworks 16,16 are preferably of truss construction and their upper members are affixed to the beams 14 and 15. The vertical structural frameworks 16,16 are connected to each other, at spaced positions along their entire length by means of transversely extending pillars and oblique members, so as to form a central strengthening structure. The bottoms of the vertical frameworks 16,16 are connected to each other, as required, by means of horizontal beams 17.

The beams 17 can be used as the support bases for tall components of equipment mounted on the transportable bed 11, such as towers. In such a case, the towers or like components are mounted so as to pass through the flat floor section 11 so that their lower ends can be directly affixed to the beams 17.

Thus, in this transportable bed, the force caused by the falling-down moment of the tall constituents such as towers due to the pitching and rolling of the barge during the marine transportation is carried not only by the flat floor section 11 but also by the entirety of the central strengthening structure. It is to be noted that the moment applied to the tower of 30 m high and 300 tons weight can be as large as 3000 ton-meter.

Other heavy constituents, such as rotary machines, can also be mounted on the horizontal beams 17. By doing so, the center of mass of the unit structure is lowered whereby to ensure an increased stability during the transportation to the installation site.

Since the heavy components are mounted on the horizontal beams 17 which are located at the lower end of the central strengthening structure, the strength of the flat floor section 12 can be smaller, as compared with the case in which all of the components are carried solely by the flat floor section 12. Consequently, it is possible to design the flat floor section 12 of reduced weight, which makes possible a considerable reduction in the total weight of the unit structure. The flat floor section 12 typically has a breadth and length ranging between 15 and 50 meters and 15 and 60 meters, respectively.

The side edges of the flat floor section 11 are supported by downwardly extending supports 18, which preferably are of truss construction. The lower edges of the supports 18 and the central strengthening structure are substantially coplanar.

The procedure for the building of industrial equipment on the transportable bed of the invention, transportation to the installation site and installation at the installation site will be described with reference to FIG. 5.

FIG. 5(*a*) shows a completed unit structure of the industrial equipment at the fabrication area, consisting of the components of the equipment mounted on the transportable bed. Subsequently, heavy duty transportation vehicles are driven into the space beneath the flat floor section on both sides of the central strengthening structure. The unit structure is then lifted up and transferred to the vehicles by jacking up the load supporting structure of the vehicle by means of the jacks carried by the vehicles themselves, as shown in FIG. 5(*b*). The unit structure is then transported from the fabrication factory to the shipping port by the heavy duty transportation vehicles which run on a transportation road specifically prepared making use of steel plates. At the shipping port, the heavy duty transportation vehicles are driven onto the barge, and the unit structure is delivered from the vehicle to the barge by operation of the jacks of the vehicles. Relatively small-sized fastening means are provided on the deck of the barge, so as to fasten the central strengthening structure against movement due to the pitching and rolling during the marine transportation.

These fastening means are extremely small-sized in comparison with those of FIGS. 1 and 2, but they can effectively function in cooperation with the central strengthening structure. The heavy duty transportation vehicle can be held on the deck, after placing the unit structure on the deck of the barge, and transported along with the unit structure to the landing port, so as to be used again for transporting the unit structure from the landing port to the installation site. Alternatively, after the delivery of the unit structure to the barge, the heavy duty transportation vehicle may be driven off the barge, and the unit structure is tightly fastened by the small-sized fastening means, as shown in FIG. 5(*c*).

Then, after the arrival at the landing port, the unit structure is delivered from the barge to a heavy duty transportation vehicle as illustrated in FIG. 5(*d*), and is transported to the installation site by the vehicle. The unit structure is then installed on the foundations as illustrated in FIG. 5(*e*), by means of the jacks carried by the vehicle. Then, a plurality of unit structures are connected to one another and to external parts of the installation, or when only one unit structure is involved, it can be connected to the external parts of the installation, thus completing the construction work.

The use of the transportable bed in accordance with the invention offers the following advantages.

1. The construction time at the installation site is remarkably shortened, and the cost of construction, especially the transportation and labor costs, is remarkably reduced. For instance, for an ammonia production plant capable of producing 1000 tons or more of ammonia per day, the construction can be completed in as short a time as 6 months, when the transportable bed of the invention is used, whereas the conventional method using no transportable bed requires a very long construction time of 20 to 24 months.

The shortening of the construction time and the elimination of troublesome jacking up and down during the transportation is very advantageous.

2. The fabrication of the unit structure at the factory can be carried out in an efficient manner, because an ample number of skilled engineers and skilled workers is available thereat, as well as because of the availability of fully-equipped fabrication and inspection machines including large-power cranes. Consequently, a unit structure of better quality can be fabricated in a shorter time.

3. The temporary foundation used in the fabrication area and the final foundation at the installation site can be made smaller.

4. It is not necessary to employ a large number of ultra-heavy duty jacks and temporary supports. At the same time, there is no practical limit for the breadth of the transportation vehicle. In addition, it becomes possible to use the entire breadth of the marine transportation vessel.

5. Machinery of heavier weight can be installed, because the load is conveniently distributed over the entire region of the central strengthening structure.

6. A smaller strength for the flat floor section is required. Especially, it becomes possible to reduce the weight on the perimeter of the flat floor section.

7. When the total industrial equipment to be installed is divided into a plurality of unit sections using a plurality of transportable beds, the temporary foundation at the fabrication area and the final foundation at the installation site can be easily and stably prepared at a low cost, as a continuous foundation running beneath the plurality of central strengthening structures of the unit structure sections. In case of a flat floor bed, a large number of continuous or discontinuous foundations are required.

8. The area within the central strengthening structure is suitable for the mounting of the pumps which require large suction head.

9. The unit structure can be automatically placed precisely at the desired position, by the installation work carried out by the use of the jacks of the heavy duty transportation vehicle, provided that coordinating guiding tapered surfaces are formed on the top of the foundation of the installation site and in a suitable position of the central strengthening structure having large strength.

The embodiments of the invention in which an exclusive property or privilege is claimed are defined as follows:

1. A transportable bed for supporting industrial equipment and machinery and adapted for use in the construction of industrial installations wherein a part or the entirety of the equipment is erected on the transportable bed at a factory to form a unit structure having a weight ranging from 500 to 5,000 tons including said transportable bed, transporting said unit structure to the installation site by means of a heavy duty transportation vehicle or by a heavy duty transportation vehicle and a vessel in combination, installing said unit structure on foundations prepared at the installation site and connecting said equipment with other parts of the industrial installation thus completing the construction, said transportable bed comprising:

a substantially rectangular, horizontal floor having a width of from about 15 to about 50 meters and a length of from about 15 to about 60 meters, said floor being made of structural floor material adapted to support industrial equipment, machinery, piping and electric wiring of the industrial installation;

a central strengthening column extending downwardly from said floor, said central strengthening column comprising two upright, elongated, parallel, horizontally spaced-apart trusses whose upper ends are secured to said floor, said trusses extending lengthwise of said floor from one longitudinal end to the other longitudinal end of said floor, said trusses being spaced laterally inwardly from the respective side edges of said floor substantially equal distances to provide unobstructed zones located on opposite sides of said central strengthening column which zones each have a size sufficient to receive the load-carrying portion of a heavy duty transportation vehicle, said zones extending lengthwise of said floor, said central strengthening column having coplanar, horizontal, transverse beams attached to and extending between the lower ends of said trusses and defining a horizontal base for said transportable bed, said central strengthening column also having transversely extending pillars and inclined structural members extending between and secured to said trusses at longitudinally spaced positions along the lengths of said trusses, said central strengthening column supporting said floor a distance of from about 0.5 to about 3.0 meters above said horizontal base at the lower end of said central strengthening column;

a pair of upright, elongated, parallel, lateral support trusses extending downwardly from said floor adjacent said side edges of said floor, said lateral support trusses being parallel with the trusses of said central strengthening column and defining the outer sides of said zones, the lower ends of said lateral support trusses being substantially coplanar with said horizontal base at the lower end of said central strengthening column;

a horizontal floor-reinforcing structure made of reinforcing beams lying directly underneath said floor and extending between the upper end of said central reinforcing column and the upper ends of said lateral support trusses and defining a horizontal bearing surface at the upper ends of said zones for engagement with said load-carrying portion of the heavy duty transportation vehicle.

2. A transportable bed according to claim 1 in which said reinforcing beams comprise a plurality of parallel, longitudinally spaced-apart beams.

3. A unit structure section of an installation of industrial equipment and machinery which comprises a transportable bed as claimed in claim 1 having mounted thereon one or more items of industrial equipment and machinery.

4. A unit structure section as claimed in claim 3 in which an item of industrial equipment and machinery extends downwardly through an opening in the central portion of said floor and the lower end of said item is mounted directly on said central strengthening column.

5. A method of building an industrial installation of industrial processing equipment, which comprises the steps of placing a transportable bed as claimed in claim 1 on an erection foundation having a centrally located erection foundation member so that said horizontal base at the lower end of said central strengthening column is supported on said centrally located erection foundation member, mounting industrial processing equipment on said bed to form a unit structure section having a weight of from 500 to 5,000 tons including said transportable bed, then placing in said zones of said transportable bed of said unit structure section the horizontal load-carrying portions of heavy duty vehicle means and then raising said load-carrying portions to lift off said unit structure section from said erection foundation, transporting said unit structure section to an installation site having an installation foundation including a centrally located installation foundation member, raising the horizontal load-carrying portions of heavy duty vehicle means which load-carrying portions are received in said zones of said transportable bed whereby to raise said unit structure section, moving said vehicle to position said unit structure section over said installation foundation so that said central strengthening column is disposed directly above said centrally located installation foundation member, then lowering said load-carrying portions of said latter heavy duty vehicle means whereby to lower said unit structure section onto said installation foundation, removing said vehicle means and connecting said processing equipment to other parts of said industrial installation.

6. A method according to claim 5 in which said unit structure section is raised off said erection foundation by diving ground transport vehicle means so that horizontal load support surfaces thereof are disposed in said zones under said horizontal bearing surface of said bed on the opposite sides of said central strengthening column, simultaneously raising said load support surfaces to lift said unit structure section off said erection foundation, driving said ground transport vehicle onto a marine vessel having a transportation foundation including a centrally located transportation foundation member, and then simultaneously lowering said load support surfaces to place said unit structure section onto said transportation foundation on said vessel so that said central strengthening column is supported on said centrally located transportation foundation member, sailing said vessel to a mooring close to the installation site, placing ground transport vehicle means onto the vessel so that the horizontal load support surfaces thereof are disposed in said zones under said horizontal bearing surface of said bed on opposite sides of said central strengthening column, simultaneously raising said load support surfaces to lift said unit structure section off said transportation foundation, driving the latter ground support vehicle to the installation site and then simultaneously lowering the latter load support surfaces to place said unit structure onto the installation foundation.

* * * * *